US010150548B2

(12) United States Patent
Ochiai et al.

(10) Patent No.: US 10,150,548 B2
(45) Date of Patent: Dec. 11, 2018

(54) OUTBOARD MOTOR AND MARINE VESSEL

(71) Applicant: YAMAHA HATSUDOKI KABUSHIKI KAISHA, Iwata-shi, Shizuoka (JP)

(72) Inventors: Katsumi Ochiai, Shizuoka (JP); Toshio Suzuki, Shizuoka (JP); Masashi Hirota, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/784,220

(22) Filed: Oct. 16, 2017

(65) Prior Publication Data

US 2018/0118317 A1 May 3, 2018

(30) Foreign Application Priority Data

Oct. 31, 2016 (JP) ..... 2016-212494

(51) Int. Cl.

| | |
|---|---|
| ***B63H 20/14*** | (2006.01) |
| ***B63H 20/06*** | (2006.01) |
| ***B63H 20/10*** | (2006.01) |
| ***B63H 20/32*** | (2006.01) |
| ***F02B 33/36*** | (2006.01) |
| ***F02B 61/04*** | (2006.01) |
| *F02B 29/04* | (2006.01) |
| *F02B 39/04* | (2006.01) |
| *F02B 75/22* | (2006.01) |

(52) U.S. Cl.

CPC ..... *B63H 20/14* (2013.01); *B63H 20/06* (2013.01); *B63H 20/10* (2013.01); *B63H 20/32* (2013.01); *F02B 33/36* (2013.01); *F02B 61/045* (2013.01); *B63B 2758/00* (2013.01); *F02B 29/04* (2013.01); *F02B 39/04* (2013.01); *F02B 75/22* (2013.01)

(58) Field of Classification Search

CPC ..... B63H 20/14; B63H 20/06; B63H 20/10; B63H 20/32; F02B 33/36; F02B 61/045

See application file for complete search history.

(56) References Cited

U.S. PATENT DOCUMENTS

| | | | | | |
|---|---|---|---|---|---|
| 2,431,806 | A * | 12/1947 | Romuald | B63H 20/10 | 123/196 W |
| 4,827,722 | A * | 5/1989 | Torigai | F02B 29/0443 | 60/599 |
| 5,293,846 | A * | 3/1994 | Takahashi | F02B 33/38 | 123/559.1 |
| 5,911,211 | A * | 6/1999 | Uchida | F02B 33/36 | 123/559.1 |
| 7,806,741 | B1 * | 10/2010 | Baier | B63H 21/38 | 440/77 |
| 9,926,831 | B1 * | 3/2018 | Ochiai | F01P 3/202 | |
| 2016/0001866 | A1 | 1/2016 | Saruwatari et al. | | |

FOREIGN PATENT DOCUMENTS

| | | | |
|---|---|---|---|
| JP | 2000-282882 | A | 10/2000 |
| JP | 2016-14330 | A | 1/2016 |

* cited by examiner

*Primary Examiner* — Stephen P Avila
(74) *Attorney, Agent, or Firm* — Keating and Bennett, LLP

(57) ABSTRACT

An outboard motor includes an engine including a plurality of cylinders, a cowling including an internal space, a drive force transmission shaft, and a supercharger driven by the drive force transmission shaft. An upper end of the supercharger is disposed below an upper end of an uppermost one of the plurality of cylinders in the internal space of the cowling.

16 Claims, 6 Drawing Sheets

OUTBOARD MOTOR AND MARINE VESSEL

This application claims the benefit of priority to Japanese Patent Application No. 2016-212494 filed on Oct. 31, 2016. The entire contents of this application are hereby incorporated herein by reference.

BACKGROUND OF THE INVENTION

1. Field of the Invention

The present invention relates to an outboard motor and a marine vessel, and more particularly, it relates to an outboard motor and a marine vessel each including a supercharger.

2. Description of the Related Art

An outboard motor including a supercharger is known in general. Such an outboard motor is disclosed in Japanese Patent Laid-Open No. 2000-282882, for example.

Japanese Patent Laid-Open No. 2000-282882 discloses an outboard motor including an engine, a cowling including an internal space in which the engine is housed, a propeller that rotates using the engine as a power source, and a crankshaft that transmits the power of the engine to the propeller. The outboard motor disclosed in Japanese Patent Laid-Open No. 2000-282882 is rotatably installed on a vessel body through a bracket. In the internal space forward of the engine in the cowling of the outboard motor disclosed in Japanese Patent Laid-Open No. 2000-282882, a supercharger is disposed in order to improve the horsepower of the outboard motor. The supercharger is a so-called mechanical supercharger that sends high-pressure air into cylinders of an engine using a rotating shaft such as a crankshaft as a drive source. In the outboard motor disclosed in Japanese Patent Laid-Open No. 2000-282882, a drive belt is mounted near an upper end of the crankshaft. The power of the crankshaft is transmitted to the supercharger forward of the engine through the drive belt.

In the outboard motor disclosed in Japanese Patent Laid-Open No. 2000-282882, an upper end of the supercharger protrudes upward beyond an upper end of the uppermost one of the cylinders. In this case, a portion of the supercharger that protrudes beyond the upper end of the uppermost cylinder is likely to interfere with the inner surface of a forward upper end of the cowling. Therefore, it is necessary to increase the height of the forward upper end of the cowling in accordance with the shape of the portion of the supercharger that protrudes beyond the upper end of the uppermost cylinder.

In the outboard motor disclosed in Japanese Patent Laid-Open No. 2000-282882, it is necessary to increase the height of the forward upper end of the cowling when the supercharger is disposed in the internal space of the cowling, and hence the size of the cowling is increased. Furthermore, it is necessary to increase the height of the forward upper end of the cowling, and hence interference between the vessel body and the cowling may occur when the outboard motor is tilted up. For these reasons, when the supercharger is disposed in the internal space of the cowling, it is desired to significantly reduce or prevent an increase in the size of the cowling and make interference between the vessel body and the cowling unlikely to occur.

SUMMARY OF THE INVENTION

Preferred embodiments of the present invention provide outboard motors and marine vessels that make interference between a vessel body and a cowling unlikely to occur when the outboard motor is tilted up while significantly reducing or preventing an increase in the size of the cowling when a supercharger is disposed in an internal space of the cowling.

An outboard motor according to a preferred embodiment of the present invention includes an engine including a plurality of cylinders, a cowling including an internal space in which the engine is housed, a drive force transmission shaft that rotates about a rotational axis extending in an upward-downward direction to transmit a drive force of the engine to a propeller, a supercharger driven by the drive force transmission shaft, and a transmission that transmits a drive force of the drive force transmission shaft to the supercharger, wherein an upper end of the supercharger is disposed below an upper end of an uppermost one of the plurality of cylinders in the internal space of the cowling. The term "upward-downward direction" denotes the upward-downward direction of the outboard motor mounted on a vessel body in a tilted-down state.

In an outboard motor according to a preferred embodiment of the present invention, the supercharger is disposed below the upper end of the uppermost one of the plurality of cylinders in the internal space of the cowling. Thus, the supercharger is installed in the internal space of the cowling without changing the shape of the cowling above the upper end of the uppermost one of the plurality of cylinders. Therefore, an increase in the height of an upper end of the cowling is significantly reduced or prevented, and hence an increase in the size of the cowling is significantly reduced or prevented. In addition, an increase in the height of a forward upper end of the cowling is significantly reduced or prevented, and hence interference between the cowling and the vessel body is unlikely to occur when the outboard motor is tilted up.

In an outboard motor according to a preferred embodiment of the present invention, in addition to the upper end of the supercharger, an upper end of the transmission is preferably disposed below the upper end of the uppermost one of the plurality of cylinders in the internal space of the cowling. Accordingly, in addition to the supercharger, the transmission is disposed below the upper end of the uppermost one of the plurality of cylinders, and hence the necessity of changing the shape of the cowling above the upper end of the uppermost one of the plurality of cylinders is significantly reduced or prevented. Therefore, an increase in the height of the (forward) upper end of the cowling is further significantly reduced or prevented, and hence an increase in the size of the cowling is further significantly reduced or prevented, and interference between the vessel body and the cowling is more unlikely to occur.

In the outboard motor including the supercharger, the supercharger is preferably disposed below an uppermost one of a plurality of connecting rods connected to a plurality of pistons disposed inside the plurality of cylinders in the internal space of the cowling. Accordingly, the supercharger is installed in the cowling without changing the shape of the cowling above the uppermost one of the plurality of connecting rods. Therefore, an increase in the height of the (forward) upper end of the cowling is further significantly reduced or prevented, and hence an increase in the size of the cowling is further significantly reduced or prevented, and interference between the cowling and the vessel body is more unlikely to occur.

In the outboard motor including the drive force transmission shaft, the drive force transmission shaft preferably includes a crankshaft, and the transmission preferably includes a drive gear that is mounted on the crankshaft and drives the supercharger. Accordingly, the power of the supercharger is acquired via the drive gear from the crankshaft. Therefore, the drive force is easily transmitted from the crankshaft to the supercharger.

In the outboard motor in which the transmission includes the drive gear, the transmission preferably includes a driven gear mounted on the supercharger and an intermediate gear disposed between the drive gear and the driven gear, in addition to the drive gear. Accordingly, a position at which the supercharger is disposed is spaced apart from the crankshaft by the size of the intermediate gear. Therefore, the supercharger is easily disposed in the internal space of the cowling.

In the outboard motor in which the transmission includes the drive gear, the drive gear of the transmission is preferably disposed between two adjacent ones of a plurality of connecting rods connected to a plurality of pistons disposed inside the plurality of cylinders. Accordingly, the drive gear is positioned between the connecting rod located at the uppermost position and the connecting rod located at the lowermost position. Therefore, the supercharger, to which the drive force is transmitted from the drive gear, is easily disposed in the cowling at a position forward of the engine, at which a small number of auxiliaries are disposed such that a space is easily ensured. Consequently, the necessity of changing the shape of the cowling due to the installation of the supercharger is significantly reduced or prevented.

In the outboard motor in which the drive gear is disposed between the two adjacent ones of the plurality of connecting rods, a side sectional shape of the cowling is preferably inclined forward and downward along a shape of the engine from a central portion to a forward end in a forward-rearward direction, and an intermediate gear of the transmission and the supercharger are preferably disposed forward of a forward end of the engine in the internal space of the cowling. Accordingly, even when the supercharger is disposed forward of the forward end of the engine, an unnecessary upward protrusion is unlikely in the shape of the forward upper end of the cowling that is inclined forward and downward. Consequently, when the outboard motor is tilted up, interference between the vessel body and the cowling is more unlikely to occur.

In the outboard motor including the transmission, the drive force transmission shaft preferably includes a crankshaft, the transmission is preferably connected to a lower end of the crankshaft, and the supercharger is preferably disposed rearward of a rearward end of the engine. Accordingly, the supercharger is disposed rearward of the rearward end of the engine, and hence the necessity of changing the shape of the forward upper end of the cowling is eliminated. Consequently, an increase in the height of the (forward) upper end of the cowling is further significantly reduced or prevented, and hence an increase in the size of the cowling is further significantly reduced or prevented, and interference between the vessel body and the cowling is more unlikely to occur when the outboard motor is tilted up.

In the outboard motor in which the transmission is connected near the lower end of the crankshaft, the drive force transmission shaft preferably includes a drive shaft connected to the crankshaft, the transmission is preferably connected at or near a connection between the crankshaft and the drive shaft, and the supercharger is preferably disposed rearward of the rearward end of the engine. Accordingly, the necessity of changing the forward shape of the cowling is significantly reduced or prevented, and the drive force of the supercharger is acquired from the crankshaft or the drive shaft. Consequently, an increase in the height of the (forward) upper end of the cowling is further significantly reduced or prevented, and hence an increase in the size of the cowling is further significantly reduced or prevented, and interference between the cowling and the vessel body is unlikely to occur when the outboard motor is tilted up. In addition, a drive source for the supercharger is able to be selected. Particularly when the transmission is the drive gear, the drive gear is mounted on the crankshaft such that the drive force of the supercharger is basically acquired from the crankshaft. However, the drive gear may be mounted on a portion of the crankshaft closer to the drive shaft (the connection between the crankshaft and the drive shaft) such that the supercharger acquires a drive force from the crankshaft and the drive shaft.

In the outboard motor in which the drive gear is disposed between the two adjacent ones of the plurality of connecting rods, the drive gear of the transmission is preferably disposed between an uppermost one of the plurality of connecting rods and a connecting rod adjacent to the uppermost one of the plurality of connecting rods. Accordingly, a connecting position between the drive gear and the crankshaft is located at a higher position as compared with the case where the drive gear is disposed between the other connecting rods. Therefore, a clearance is provided between a lower end of the supercharger to which a drive force is transmitted from the drive gear and the cowling, and hence the necessity of changing the shape of a forward lower portion of the cowling is significantly reduced or prevented.

In the outboard motor in which the supercharger is disposed rearward of the rearward end of the engine, the transmission preferably includes a chain or a belt that transmits a drive force of the crankshaft disposed in a forward portion of the engine to the supercharger disposed rearward of the engine. Accordingly, even when the supercharger is spaced apart by a distance from the crankshaft, the supercharger and the drive force transmission shaft are connected to each other by adjusting the length of the belt or the chain. Consequently, the degree of freedom in designing the outboard motor is improved.

In the outboard motor in which the supercharger is disposed rearward of the rearward end of the engine, the supercharger is preferably disposed adjacent to the rearward end of the engine. Accordingly, a distance between the supercharger and the rearward end of the engine becomes shorter than when the supercharger and the rearward end of the engine are spaced apart by a distance from each other. Therefore, even when it is necessary to change the shape of the cowling near the rearward end of the engine, the change is significantly reduced or prevented.

In the outboard motor in which the supercharger is disposed rearward of the rearward end of the engine, the supercharger is preferably disposed below a lower end of the engine and rearward of the rearward end of the engine. Accordingly, the supercharger is not disposed above the lower end of the engine in the internal space of the cowling. Furthermore, the supercharger is not disposed forward of the rearward end of the engine. Therefore, the necessity of changing the shape of the cowling above the lower end of the engine, particularly at a forward position, is eliminated.

In the outboard motor including the engine, the engine is preferably a V-type or V-shaped engine, the engine preferably includes a pair of cylinders that face each other in a direction perpendicular or substantially perpendicular to the upward-downward direction, and an exhaust passage or an intake passage is preferably disposed between the pair of cylinders. Accordingly, an exhaust passage or an intake passage connected to each of the plurality of cylinders is integrated into the exhaust passage or the intake passage between the pair of cylinders. Therefore, the exhaust passage or the intake passage is downsized, and hence a space between the engine and the cowling is increased.

In the outboard motor including the engine, the engine is preferably a V-type or V-shaped engine, and the engine preferably includes a pair of cylinders that face each other in a direction perpendicular or substantially perpendicular to the upward-downward direction. In addition, the outboard motor preferably further includes an intercooler that cools compressed air from the supercharger, and the intercooler is preferably disposed forward of a forward end of the engine and at a position that corresponds to a position between the pair of cylinders in the internal space of the cowling. Accordingly, the intercooler is disposed in the cowling at a position forward of the engine, at which a small number of auxiliaries are disposed such that a space is easily ensured. Consequently, the necessity of changing the shape of the cowling due to the installation of the intercooler is significantly reduced or prevented.

A marine vessel according to a preferred embodiment of the present invention includes an outboard motor and a vessel body on which the outboard motor is rotatably mounted, the outboard motor includes an engine including a plurality of cylinders, a cowling including an internal space in which the engine is housed, a drive force transmission shaft that rotates about a rotational axis extending in an upward-downward direction to transmit a drive force of the engine to a propeller, a supercharger driven by the drive force transmission shaft, and a transmission that transmits a drive force of the drive force transmission shaft to the supercharger, and an upper end of the supercharger is disposed below an upper end of an uppermost one of the plurality of cylinders in the internal space of the cowling.

In a marine vessel according to a preferred embodiment of the present invention, the supercharger is disposed below the upper end of the uppermost one of the plurality of cylinders in the internal space of the cowling. Thus, the supercharger is installed in the cowling without changing the shape of the cowling above the upper end of the uppermost one of the plurality of cylinders. Therefore, an increase in the height of an upper end of the cowling is significantly reduced or prevented, and hence an increase in the size of the cowling is significantly reduced or prevented. In addition, an increase in the height of the (forward) upper end of the cowling is significantly reduced or prevented, and hence interference between the cowling and the vessel body is unlikely to occur when the outboard motor is tilted up.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

An outboard motor 100 according to a first preferred embodiment of the present invention is now described with reference to FIGS. 1 to 4. In the first preferred embodiment, the outboard motor 100 is rotatably mounted on a vessel body 10 of a marine vessel 1 through a bracket 25.

The structure of the outboard motor 100 on the marine vessel 1 according to the first preferred embodiment of the present invention is now described with reference to FIG. 1. In the figures, arrow F represents the forward movement direction (hereinafter referred to as the forward direction) of the marine vessel 1, and arrow B represents the rearward movement direction (hereinafter referred to as the rearward direction) of the marine vessel 1. In the figures, arrow R represents the starboard direction of the marine vessel 1, and arrow L represents the portside direction of the marine vessel 1. In the figures, arrow U represents an upward direction, and arrow D represents a downward direction.

Figure 1:
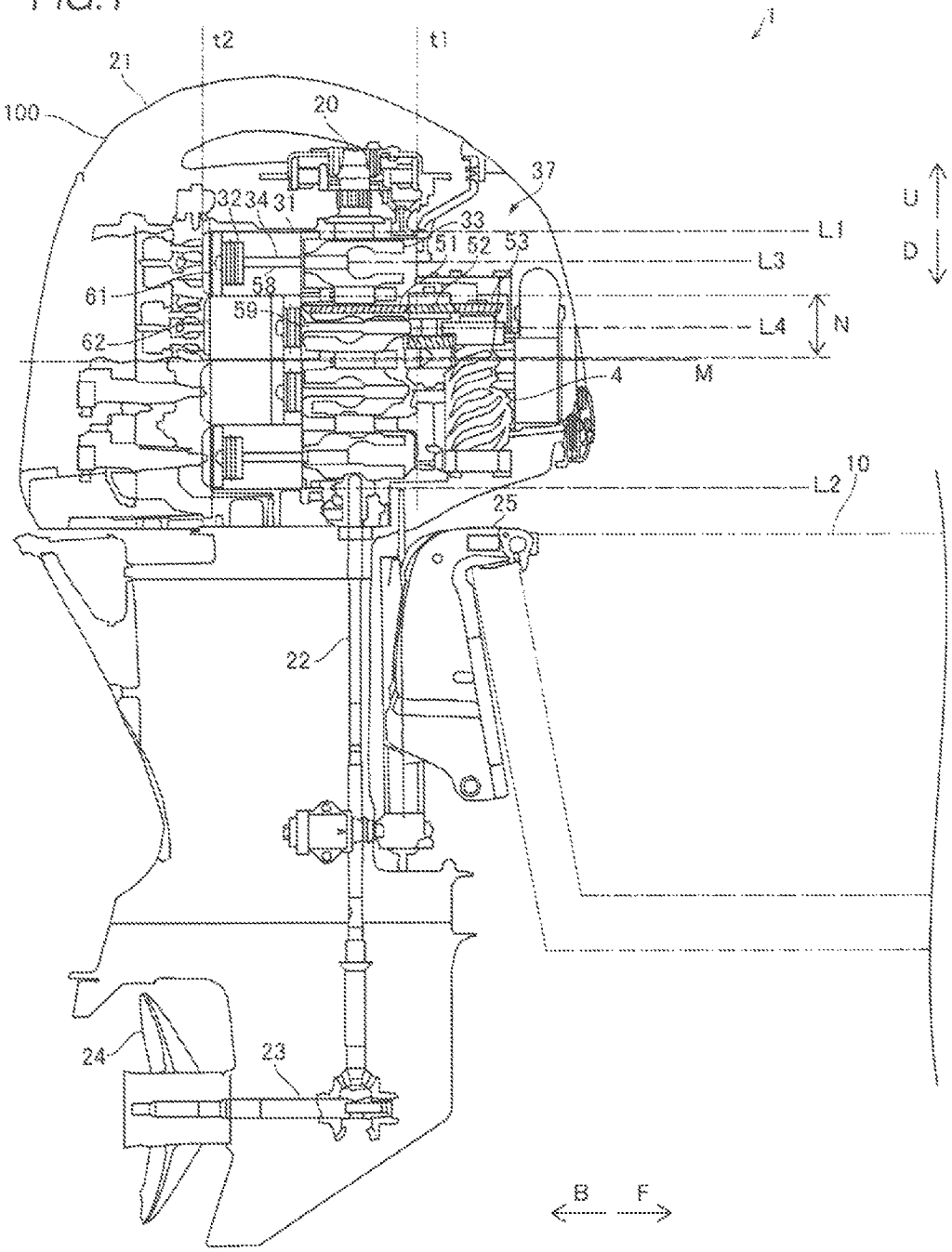
FIG. 1 is a side sectional view of a marine vessel including an outboard motor according to a first preferred embodiment of the present invention.

As shown in FIG. 1, the outboard motor 100 generates a thrust force to cause the marine vessel 1 to travel. The outboard motor 100 is mounted on a rear portion of the vessel body 10. The outboard motor 100 includes an engine 20, a cowling 21, a drive shaft 22, a propeller shaft 23, a propeller 24, and the bracket 25. The drive shaft 22 is an example of a "drive force transmission shaft".

The engine 20 is preferably an internal combustion engine driven by explosive combustion of gasoline, light oil, or the like, and is controlled by an ECU (engine control unit) (not shown). Specifically, the engine 20 according to the first preferred embodiment is, for example, a four-stroke engine and an in-line engine. The engine 20 is installed in an upper portion of the outboard motor 100. The engine 20 includes a plurality of (four, for example) cylinders 31, a plurality of (four, for example) pistons 32, a crankshaft 33, and a plurality of (four, for example) connecting rods 34. The crankshaft 33 is another example of a "drive force transmission shaft".

The plurality of cylinders 31 is disposed in a row in an upward-downward direction. Each of the plurality of cylinders 31 has a cylindrical shape including an opening in the forward direction. A cylinder head 35 located rearward of each of the plurality of cylinders 31 includes exhaust ports 351 through which exhaust gas is discharged from the plurality of cylinders 31, respectively, and intake ports 352 through which fuel and air are supplied to the plurality of cylinders 31, respectively. The plurality of connecting rods 34 are inserted through the forward opening of the plurality of cylinders 31.

The plurality of pistons 32 are disposed inside the plurality of cylinders 31. Each of the plurality of pistons 32 is slidable in a direction in which the central axis of each of the plurality of cylinders 31 extends. The plurality of pistons 32 slide in the plurality of cylinders 31 in a forward-rearward direction.

Figure 3:
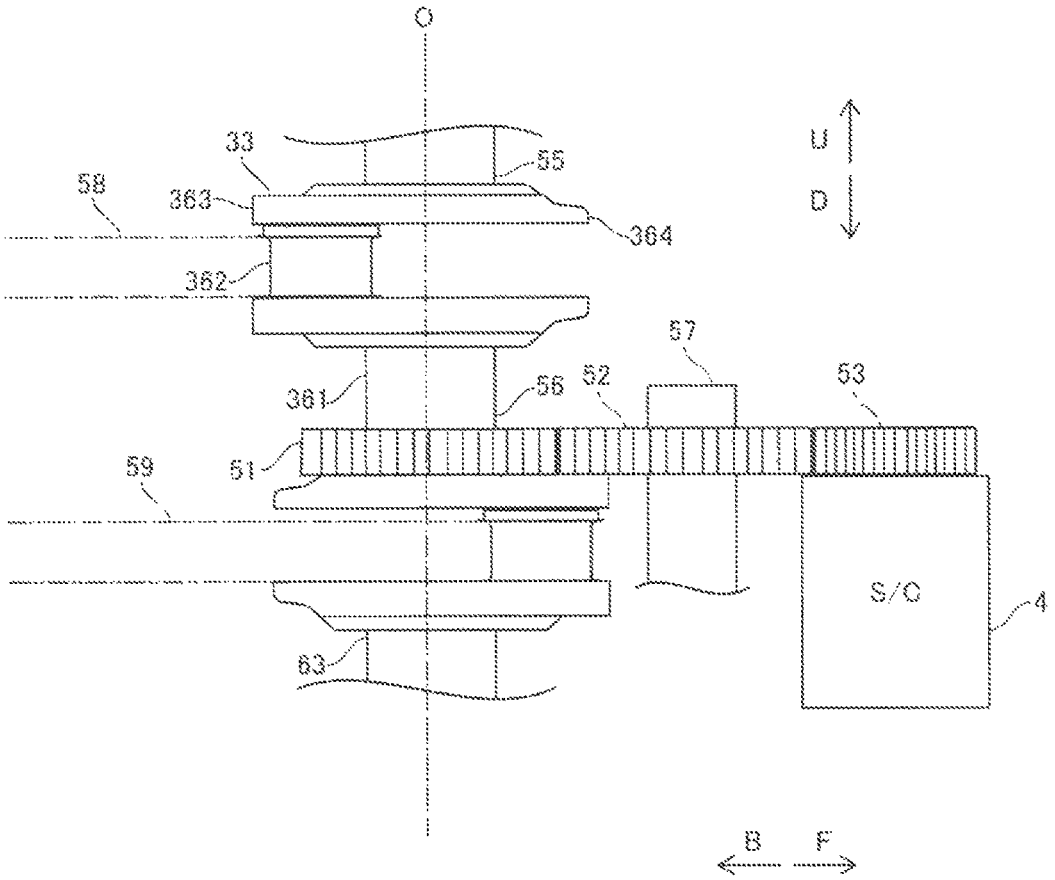
FIG. 3 is a schematic view showing a crankshaft, a supercharger, and a transmission according to the first preferred embodiment of the present invention.

As shown in FIG. 3, the crankshaft 33 includes crank journals 361, crank pins 362, crank arms 363, and counter weights 364. A plurality of crank journals 361 are disposed on the same rotational axis O. The crankpins 362 are disposed at positions displaced from the rotational axis O of the crank journals 361. A plurality of crank pins 362 are included. The crank arms 363 mechanically connect the crank journals 361 to the crank pins 362. The counter weights 364 are appropriately mounted on the crank arms 363.

As shown in FIG. 1, the plurality of connecting rods 34 mechanically connect the plurality of pistons 32 to the crankshaft 33. Specifically, the plurality of connecting rods 34 couple the plurality of pistons 32 to the plurality of crank pins 362. The plurality of connecting rods 34 are aligned in the upward-downward direction. Due to the connecting rods 34 and the crankshaft 33, the linear movement of the pistons 32 in a right-left direction is changed to a rotational movement about the rotational axis O that extends in the upward-downward direction.

In the engine 20, the fuel injected into and the air taken into each of the plurality of cylinders 31 (hereinafter referred to as the air-fuel mixture) are compressed by the pistons 32. The compressed air-fuel mixture is ignited by a spark plug (not shown). The air-fuel mixture explodes and burns by ignition such that the pistons 32 slide in the cylinders 31, and the crankshaft 33 rotates. Thus, the drive force of the engine 20 is transmitted to the crankshaft 33.

The cowling 21 covers the engine 20. Specifically, the cowling 21 includes an internal space 37 in which the engine 20 is housed. Furthermore, the cowling 21 covers the engine 20 from above and from the side. Therefore, the internal space 37 is provided above and lateral to the engine 20. The side sectional shape of the cowling 21 is semicircular or substantially semicircular along the shape of the engine 20. That is, the side sectional shape of the cowling 21 is inclined forward and upward from the rearward end to the central portion in the forward-rearward direction, and is inclined forward and downward from the central portion to the forward end in the forward-rearward direction. The cowling 21 is preferably a thin plate and made of a synthetic resin, for example.

The drive shaft 22 transmits the power of the engine 20 transmitted from the crankshaft 33 to the propeller shaft 23. The drive shaft 22 extends in the upward-downward direction. An upper end of the drive shaft 22 is mechanically connected to the crankshaft 33, and a lower end thereof is mechanically connected to the propeller shaft 23.

The propeller shaft 23 transmits the power of the engine 20 transmitted from the drive shaft 22 to the propeller 24. The propeller shaft 23 extends in the forward-rearward direction. A forward end of the propeller shaft 23 is mechanically connected to the drive shaft 22, and a rearward end thereof is mechanically connected to the propeller 24.

The propeller 24 (screw) is mechanically connected to the propeller shaft 23. The propeller 24 is rotationally driven about its rotational axis that extends in the forward-rearward direction. The propeller 24 generates a thrust force in a direction in which the rotational axis of the propeller shaft 23 extends by rotating in water. The propeller 24 moves the vessel body 10 forward or rearward according to its rotational direction.

A forward end of the bracket 25 is fixed to the vessel body 10, and a rearward end thereof supports the outboard motor 100 such that the outboard motor 100 is rotatable. The bracket 25 allows the outboard motor 100 to freely rotate about its rotational axis parallel or substantially parallel to the right-left direction. The outboard motor 100 is rotated in a clockwise direction about the rotational axis of the bracket 25 as viewed from the right to be tilted up. The outboard motor 100 is rotated counterclockwise about the rotational axis of the bracket 25 as viewed from the right to be tilted down.

Figure 2:
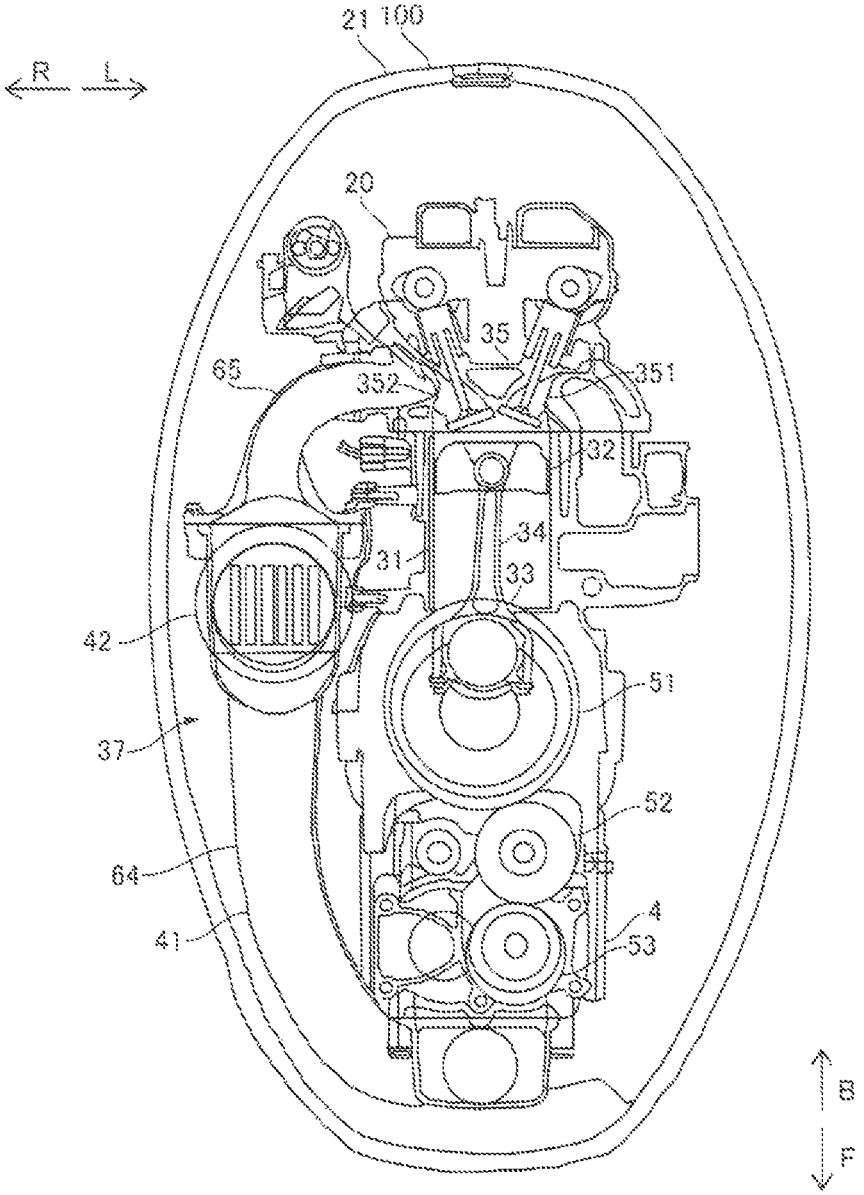
FIG. 2 is a transverse sectional view of the outboard motor according to the first preferred embodiment of the present invention.

The outboard motor 100 according to the first preferred embodiment includes a supercharger 4 in order to increase the horsepower of the engine 20. The supercharger 4 compresses air with a power transmitted from the crankshaft 33. The supercharger 4 is a mechanical supercharger (S/C). The supercharger 4 compresses air based on the power transmitted from the crankshaft 33. The position of an upper end of the supercharger 4 is lower than the position L1 of an upper end of the uppermost one of the plurality of cylinders 31. The position of a lower end of the supercharger 4 is higher than the position L2 of a lower end of the lowermost one of the plurality of cylinders 31. As shown in FIG. 2, the supercharger 4 includes an air passage 41 and an intercooler 42.

The air passage 41 connects the supercharger 4 to each of the plurality of cylinders 31 of the engine 20. The compressed air compressed by the supercharger 4 passes through the air passage 41 and flows to each of the plurality of cylinders 31. The intercooler 42 is disposed in the air passage 41. The intercooler 42 cools the high-temperature compressed air that flows through the air passage 41.

As shown in FIG. 3, the outboard motor 100 according to the first preferred embodiment includes a drive gear 51, a balancer drive gear 52, and a driven gear 53 that transmit the power of the crankshaft 33 to the supercharger 4. The drive gear 51, the balancer drive gear 52, and the driven gear 53 are examples of a "transmission".

The drive gear 51 transmits the drive force of the engine 20 transmitted from the crankshaft 33 to the supercharger 4. Thus, the supercharger 4 is driven. Specifically, the drive gear 51 is fixed to the crankshaft 33. The drive gear 51 is fitted into a second crank journal 56 adjacent to a first crank journal 55 located at the uppermost position of the crankshaft 33. The drive gear 51 is disposed at a lower end of the second crank journal 56.

The balancer drive gear 52 is disposed between the drive gear 51 and the driven gear 53 of the supercharger 4. The balancer drive gear 52 is mechanically connected by meshing with the drive gear 51 and the driven gear 53. The balancer drive gear 52 rotates with a shaft 57 having a rotational axis parallel or substantially parallel to the rotational axis of the crank journal 361. The power of the shaft 57 is acquired from the crankshaft 33. The balancer drive gear 52 is preferably made of metal.

The disposition of the supercharger 4 in the cowling 21 of the outboard motor 100 is now described.

In the outboard motor 100 according to the first preferred embodiment, as shown in FIG. 1, the supercharger 4 is disposed in a forward portion of the internal space 37 of the cowling 21. In particular, the supercharger 4 is disposed forward of the position t1 of a forward end of the engine 20 in the internal space 37 of the cowling 21. The supercharger 4 is adjacent to the crankshaft 33 in the forward-rearward direction. As shown in FIGS. 1 and 3, the supercharger 4 is disposed below the position L3 of the uppermost one of the plurality of connecting rods 34 or the position L3 of the center of a crank pin 362 to which the uppermost connecting rod 34 is coupled. As described above, the supercharger 4 is disposed above the position L2 of the lower end of the lowermost cylinder 31.

A clearance is provided between the upper end of the supercharger 4 and the inner surface of the cowling 21. A clearance is provided between a forward end of the supercharger 4 and the inner surface of the cowling 21. A clearance is provided between a rearward end of the supercharger 4 and the inner surface of the cowling 21.

As shown in FIG. 2, the supercharger 4 is disposed in a central portion of the internal space 37 of the cowling 21 in the right-left direction. A clearance is provided between a right end of the supercharger 4 and the inner surface of the cowling 21. A clearance is provided between a left end of the supercharger 4 and the inner surface of the cowling 21.

As shown in FIG. 1, the drive gear 51 is fixed at a position above a central portion M of the crankshaft 33 in the upward-downward direction. The drive gear 51 is disposed between the position L3 of a first connecting rod 58 located at the uppermost position and the position L4 of a second connecting rod 59 adjacent to the first connecting rod 58 in the upward-downward direction. It is assumed that a second cylinder 62 is adjacent to a first cylinder 61 located at the uppermost position. In this case, the drive gear 51 is disposed within a range N from an upper end of the inner surface of the second cylinder 62 to a lower end thereof in the upward-downward direction. Furthermore, as shown in FIG. 3, the drive gear 51 is disposed between the second crank journal 56 located below the first crank journal 55 located at the uppermost position and a third crank journal 63 located below the second crank journal 56. The balancer drive gear 52 and the driven gear 53 are disposed at the same position as the drive gear 51 in the upward-downward direction.

In the outboard motor 100, as shown in FIG. 2, the intercooler 42 of the supercharger 4 is preferably disposed in a right portion of the internal space 37 of the cowling 21. In other words, the intercooler 42 is disposed near the intake ports 352 of the cylinders 31 in the internal space 37 of the cowling 21. The air passage 41 includes a first air passage 64 that connects the supercharger 4 to the intercooler 42 and a second air passage 65 that connects the intercooler 42 to the intake ports 352.

According to the first preferred embodiment of the present invention, the following advantageous effects are achieved.

According to the first preferred embodiment of the present invention, the outboard motor 100 includes the supercharger 4 disposed below the position L1 of the upper end of the uppermost cylinder 31 in the internal space 37 of the cowling 21. Thus, the supercharger 4 is installed in the internal space 37 of the cowling 21 without changing the shape of the cowling 21 above the position L1 of the upper end of the uppermost cylinder 31. Therefore, an increase in the height of an upper end of the cowling 21 is significantly reduced or prevented, and hence an increase in the size of the cowling 21 is significantly reduced or prevented. In addition, an increase in the height of a forward upper end of the cowling 21 is significantly reduced or prevented, and hence interference between the cowling 21 and the vessel body 10 is unlikely to occur when the outboard motor 100 is tilted up.

According to the first preferred embodiment of the present invention, in addition to the supercharger 4, the drive gear 51, the balancer drive gear 52, and the driven gear 53 are disposed below the position L1 of the upper end of the first cylinder 61. Thus, the necessity of changing the shape of the cowling 21 above the position L1 of the upper end of the first cylinder 61 is significantly reduced or prevented. Therefore, an increase in the height of the (forward) upper end of the cowling 21 is further significantly reduced or prevented, and hence an increase in the size of the cowling 21 is further significantly reduced or prevented, and interference between the vessel body 10 and the cowling 21 is more unlikely to occur.

According to the first preferred embodiment of the present invention, the supercharger 4 is disposed below the position L3 of the first connecting rod 58 in the internal space 37 of the cowling 21. Thus, the supercharger 4 is installed in the cowling 21 without changing the shape of the cowling 21 above the position L3 of the first connecting rod 58. Therefore, an increase in the height of the (forward) upper end of the cowling 21 is further significantly reduced or prevented, and hence an increase in the size of the cowling 21 is further significantly reduced or prevented, and interference between the cowling 21 and the vessel body 10 is more unlikely to occur.

According to the first preferred embodiment of the present invention, the drive gear 51 is mounted on the crankshaft 33. Thus, the power of the supercharger 4 is acquired via the drive gear 51 from the crankshaft 33 disposed in an upper portion of the outboard motor 100. Therefore, the drive force is easily transmitted from the crankshaft 33 to the supercharger 4.

According to the first preferred embodiment of the present invention, the balancer drive gear 52 is disposed between the drive gear 51 and the driven gear 53. Thus, a position at which the supercharger 4 is disposed is spaced apart from the engine 20 by the size of the balancer drive gear 52. Therefore, the supercharger 4 is easily disposed in the internal space 37 of the cowling 21.

According to the first preferred embodiment of the present invention, the drive gear 51 is disposed between two adjacent connecting rods 34 of the plurality of connecting rods 34. Thus, the drive gear 51 is positioned between the first connecting rod 58 and the connecting rod 34 located at the lowermost position. Therefore, the supercharger 4, to which the drive force is transmitted from the drive gear 51, is easily disposed in the cowling 21 at a position at which a small number of auxiliaries are disposed such that a space is easily ensured. Consequently, the necessity of changing the shape of the cowling 21 due to the installation of the supercharger 4 is significantly reduced or prevented.

According to the first preferred embodiment of the present invention, the side sectional shape of the cowling 21 is inclined forward and downward from the central portion to the forward end in the forward-rearward direction. Thus, an unnecessary upward protrusion is hardly provided in the shape of the forward upper end of the cowling 21. Consequently, when the outboard motor 100 is tilted up, interference between the vessel body 10 and the cowling 21 is more unlikely to occur.

According to the first preferred embodiment of the present invention, the drive gear 51 is disposed between the first connecting rod 58 and the second connecting rod 59. Thus, a connecting position between the drive gear 51 and the crankshaft 33 is located at a higher position as compared with the case where the drive gear 51 is disposed between the other connecting rods 34. Therefore, a clearance is provided between the lower end of the supercharger 4 and a lower end of the cowling 21, and hence the necessity of changing the shape of a forward lower portion of the cowling 21 is significantly reduced or prevented.

According to the first preferred embodiment of the present invention, the drive gear 51 is fixed to the crankshaft 33, and the supercharger 4 is driven by the drive gear 51. Thus, the power of the supercharger 4 is acquired by the drive gear 51 from the crankshaft 33 that is disposed in the upper portion of the outboard motor 100, and hence the supercharger 4 is unlikely to be disposed below a lower end of the crankshaft 33. Therefore, the necessity of changing the shape of the cowling 21 is significantly reduced or prevented.

According to the first preferred embodiment of the present invention, the engine 20 is preferably an in-line engine, and the intercooler 42 is disposed on the left or the right side relative to the engine 20. Thus, in the case of an in-line engine, it is easier to provide a space on the left and right sides than on the front and rear sides relative to the engine 20, and hence the space is effectively utilized. Therefore, the shape of the cowling 21 is more unlikely to be changed.

Second Preferred Embodiment

The overall structure of an outboard motor 400 according to a second preferred embodiment of the present invention is now described with reference to FIG. 4. In the second preferred embodiment, in addition to the structure of the first preferred embodiment, a supercharger 4 is disposed rearward of the engine. In the second preferred embodiment, the same structures as those of the first preferred embodiment are denoted by the same reference numerals and description thereof will be omitted. Also in the second preferred embodiment, the outboard motor 400 is rotatably mounted on a vessel body 10 (see FIG. 1) through a bracket 25 as in the first preferred embodiment.

The outboard motor 400 according to the second preferred embodiment includes a chain 70 that transmits the power of a crankshaft 33 to the supercharger 4. The outboard motor 400 may include a belt that transmits the power of the crankshaft 33 to the supercharger 4 instead of the chain 70. The chain 70 is mechanically connected to a lower end of the crankshaft 33 at or near a connection between the crankshaft 33 and a drive shaft 22. The lower end of the crankshaft 33 is in the vicinity of an upper end of the drive shaft 22. A first end of the chain 70 is connected to the supercharger 4, and a second end thereof is connected to the lower end of the crankshaft 33. That is, the chain 70 is mounted between the supercharger 4 and the lower end of the crankshaft 33. The first end of the chain 70 may be connected to the supercharger 4, and the second end thereof may be connected to the upper end of the drive shaft 22. Thus, in the outboard motor 400 according to the second preferred embodiment, the chain 70 is selectively connected to the drive shaft 22 or the crankshaft 33.

Figure 4:
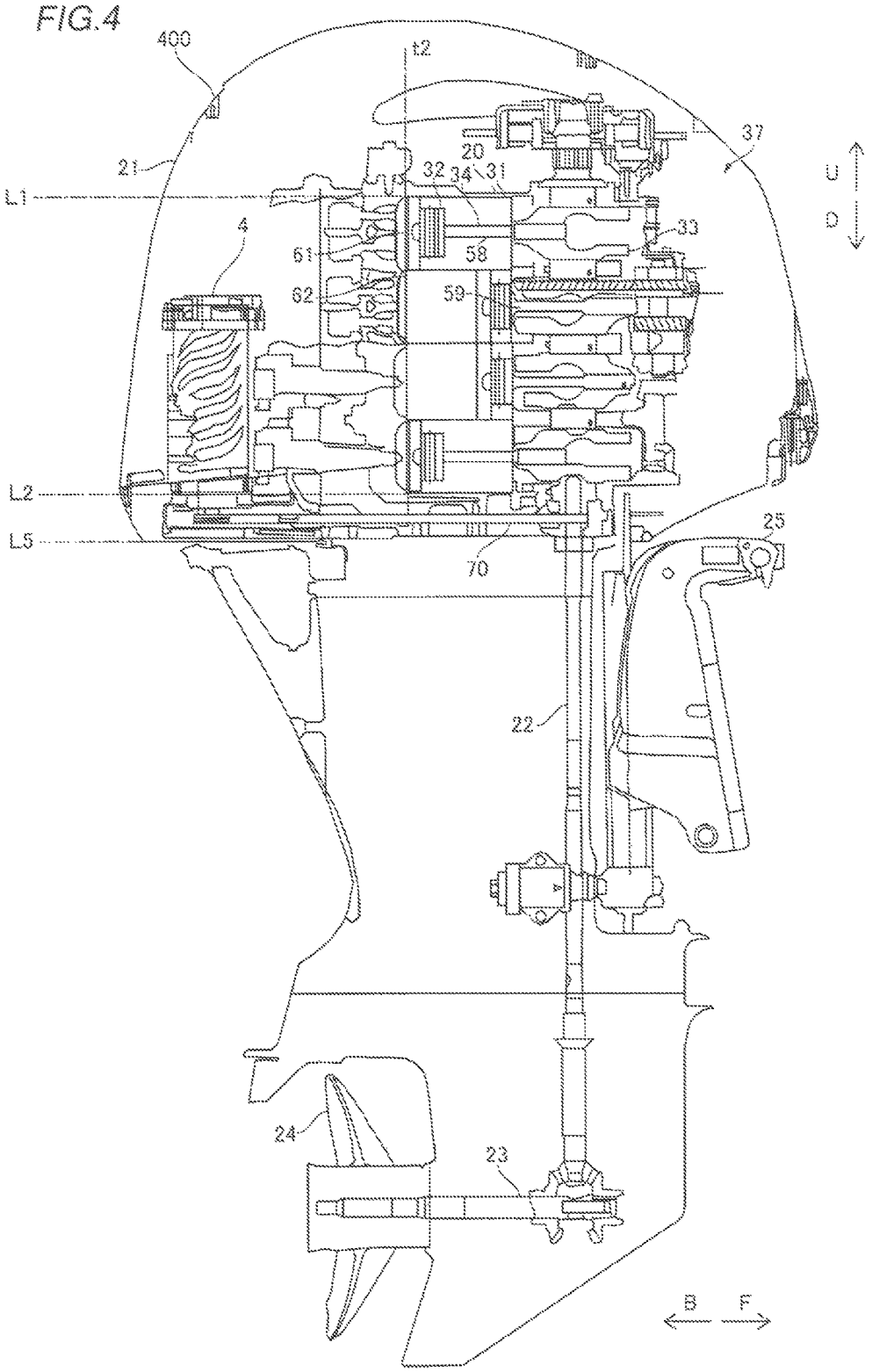
FIG. 4 is a side sectional view of an outboard motor according to a second preferred embodiment of the present invention.

In the outboard motor 400 according to the second preferred embodiment, as shown in FIG. 4, the supercharger 4 is disposed in a rearward portion of an internal space 37 of a cowling 21. In particular, the supercharger 4 is disposed rearward of the position t2 of the rearward ends of a plurality of cylinders 31 in the internal space 37 of the cowling 21. The supercharger 4 and the position t2 of the rearward ends of the cylinders 31 are adjacent to each other in a forward-rearward direction. The supercharger 4 is disposed in the rearward portion opposite to a forward portion where the crankshaft 33 is disposed in the internal space 37 of the cowling 21. The supercharger 4 is disposed below the position L1 of a lower end of the uppermost one of the plurality of cylinders 31. The supercharger 4 is disposed above the position L5 of a lower end of the cowling 21. A clearance is provided between an upper end of the supercharger 4 and the inner surface of the cowling 21. A clearance is provided between a rearward end of the supercharger 4 and the inner surface of the cowling 21.

The chain 70 extends parallel or substantially parallel to the forward-rearward direction. The chain 70 is fixed at a position above the position L5 of the lower end of the cowling 21. The chain 70 is disposed below the position L2 of a lower end of the lowermost one of the plurality of cylinders 31. That is, the chain 70 is disposed between the position L5 of the lower end of the cowling 21 and the position L2 of the lower end of the lowermost cylinder 31.

The remaining structures of the second preferred embodiment are similar to those of the first preferred embodiment.

According to the second preferred embodiment of the present invention, the following advantageous effects are achieved.

According to the second preferred embodiment of the present invention, the chain 70 is connected to the lower end of the crankshaft 33 in the vicinity of the upper end of the drive shaft 22, and the supercharger 4 is disposed rearward of the position t2 of the rearward ends of the cylinders 31. Thus, the necessity of changing the shape of a forward upper end of the cowling 21 is eliminated. Consequently, an increase in the height of the (forward) upper end of the cowling 21 is further significantly reduced or prevented, and hence an increase in the size of the cowling 21 is further significantly reduced or prevented, and interference between the cowling 21 and the vessel body 10 is unlikely to occur when the outboard motor 400 is tilted up.

According to the second preferred embodiment of the present invention, the chain 70 is connected to the lower end of the crankshaft 33 at the connection between the crankshaft 33 and the drive shaft 22, and the supercharger 4 is disposed rearward of the position t2 of the rearward ends of the cylinders 31. Thus, the necessity of changing the shape of the forward upper end of the cowling 21 is eliminated. Therefore, an increase in the height of the (forward) upper end of the cowling 21 is further significantly reduced or prevented, and hence an increase in the size of the cowling 21 is further significantly reduced or prevented, and interference between the cowling 21 and the vessel body 10 is unlikely to occur when the outboard motor 400 is tilted up.

According to the second preferred embodiment of the present invention, the supercharger 4 is disposed adjacent to the position t2 of the rearward ends of the cylinders 31. Thus, a distance between the supercharger 4 and the rearward ends of the cylinders 31 becomes shorter than when the supercharger 4 and the rearward ends of the cylinders 31 are spaced apart by a distance from each other. Therefore, even when it is necessary to change the shape of the cowling 21 near a rearward end of an engine 20, the change is significantly reduced or prevented.

According to the second preferred embodiment of the present invention, the supercharger 4 may be driven not by the chain 70 but by a belt. Thus, it is not necessary to provide an oil chamber, and hence it is not necessary to provide a seal structure required in the case of the chain 70. Therefore, the structure of the engine 20 of the outboard motor 400 is simplified.

The remaining advantageous effects of the second preferred embodiment are similar to those of the first preferred embodiment.

Third Preferred Embodiment

The overall structure of an outboard motor 500 according to a third preferred embodiment of the present invention is now described with reference to FIG. 5. In the third preferred embodiment, in addition to the structures of the first preferred embodiment and the second preferred embodiment, a supercharger 4 is disposed rearward of and below an engine 20. In the third preferred embodiment, the same structures as those of the first and second preferred embodiments are denoted by the same reference numerals and description thereof will be omitted. Also in the third preferred embodiment, the outboard motor 500 is rotatably mounted on a vessel body 10 (see FIG. 1) through a bracket 25 as in the first and second preferred embodiments.

Figure 5:
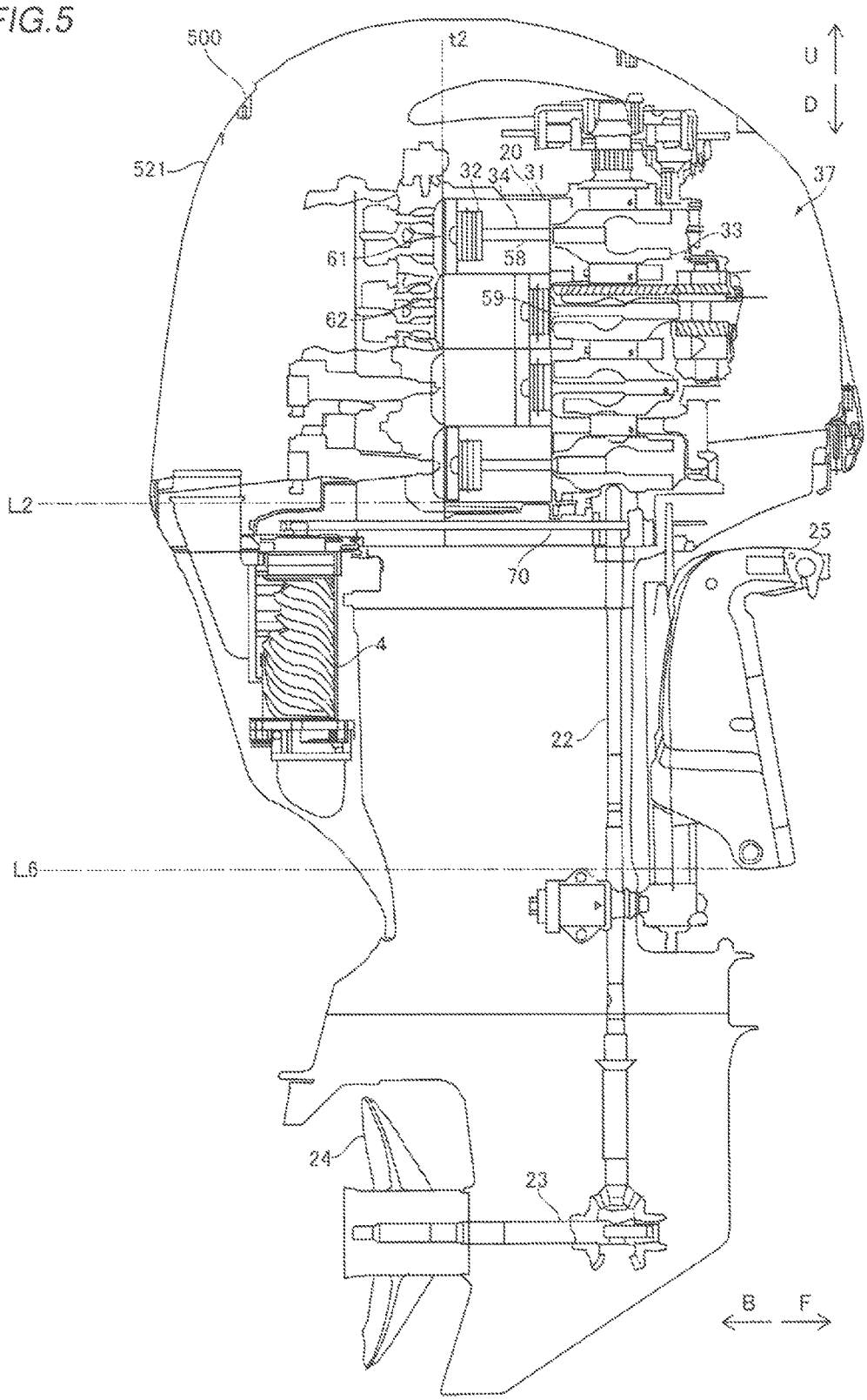
FIG. 5 is a side sectional view of an outboard motor according to a third preferred embodiment of the present invention.

In the outboard motor 500 according to the third preferred embodiment, as shown in FIG. 5, the supercharger 4 is disposed in a rearward portion of an internal space 37 of a cowling 521. That is, the supercharger 4 is disposed in the rearward portion opposite to a forward portion where a crankshaft 33 is disposed in the internal space 37 of the cowling 521. Furthermore, the supercharger 4 is disposed rearward of a rearward end of the engine 20 in the internal space 37 of the cowling 521, particularly the position t2 of rearward ends of a plurality of cylinders 31. The supercharger 4 is also disposed below a lower end of the engine 20, particularly the position L2 of a lower end of the lowermost one of the plurality of cylinders 31. The supercharger 4 is disposed above the position L6 of a lower end of the bracket 25 in an upward-downward direction. That is, the supercharger 4 is disposed between the position L6 of the lower end of the bracket 25 and the position L2 of the lower end of the lowermost cylinder 31. The supercharger 4 shown in FIG. 5 is upside down from the supercharger 4 according to the second preferred embodiment shown in FIG. 4. A clearance is provided between a lower end of the supercharger 4 and the inner surface of the cowling 521. A clearance is provided between a rearward end of the supercharger 4 and the inner surface of the cowling 521.

The remaining structures of the third preferred embodiment are similar to those of the first and second preferred embodiments.

According to the third preferred embodiment of the present invention, the following advantageous effects are achieved.

According to the third preferred embodiment of the present invention, the supercharger 4 is disposed below the position L2 of the lower end of the lowermost cylinder 31 and rearward of the position t2 of the rearward ends of the cylinders 31. Thus, the supercharger 4 is not disposed above the position L2 of the lower end of the lowermost cylinder 31 in the internal space 37 of the cowling 521. Therefore, the necessity of changing the shape of the cowling 521 above the position L2 of the lower end of the lowermost cylinder 31 is eliminated.

The remaining effects of the third preferred embodiment are similar to those of the first and second preferred embodiments.

Fourth Preferred Embodiment

Figure 6:
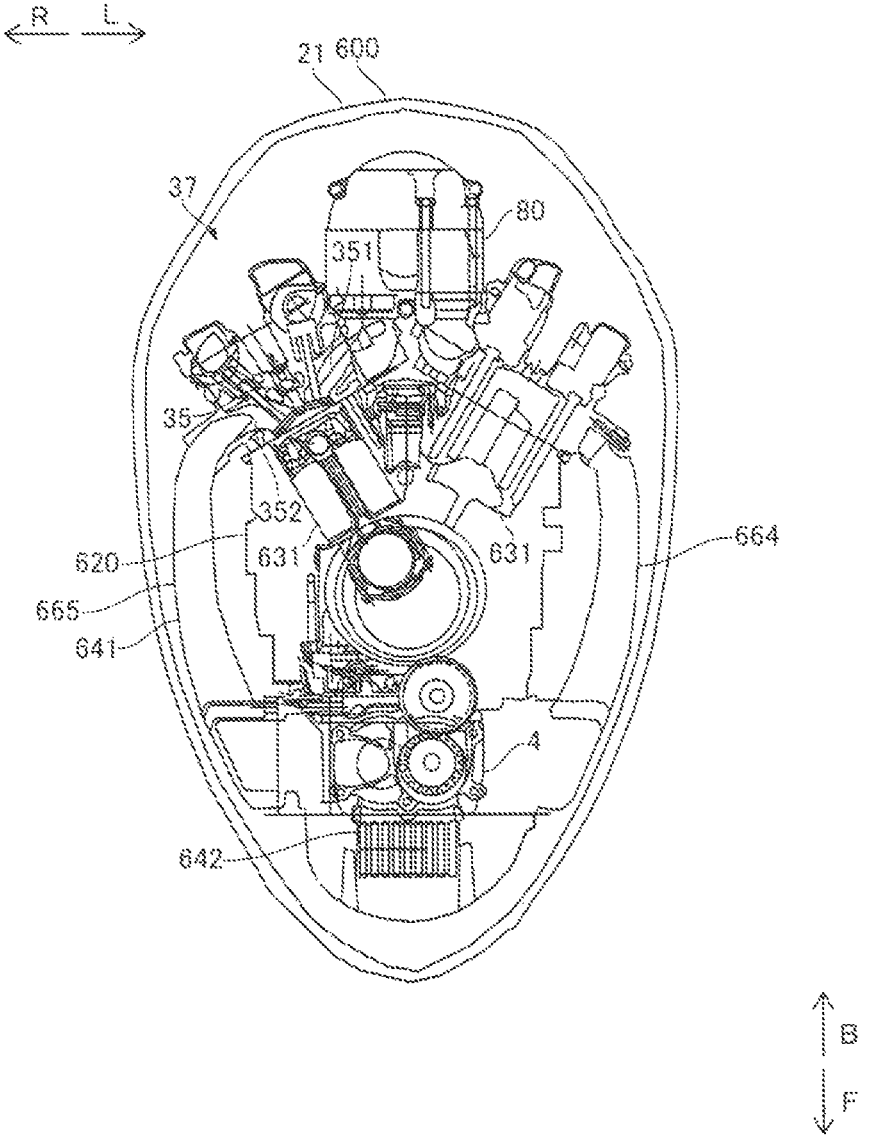
FIG. 6 is a transverse sectional view of an outboard motor according to a fourth preferred embodiment of the present invention.

The overall structure of an outboard motor 600 according to a fourth preferred embodiment of the present invention is now described with reference to FIG. 6. In the fourth preferred embodiment, in addition to the structures of the first, second, and third preferred embodiments, an engine 620 is a V-type or V-shaped engine. In the fourth preferred embodiment, the same structures as those of the first, second, and third preferred embodiments are denoted by the same reference numerals and description thereof will be omitted. Also in the fourth preferred embodiment, the outboard motor 600 is rotatably mounted on a vessel body 10 (see FIG. 1) through a bracket 25 as in the first, second, and third preferred embodiments.

The engine 620 includes a plurality of (four, for example) cylinders 631 and an exhaust passage 80. The engine 620 according to the fourth preferred embodiment is a V-type or V-shaped engine. That is, the plurality of cylinders 631 are disposed in two rows in an upward-downward direction. In addition, the plurality of cylinders 631 include two pairs of cylinders 631 that face each other in a right-left direction. The pairs of cylinders 631 that face each other in the right-left direction are disposed generally at the same position in the upward-downward direction. Each of the central axes of the pairs of cylinders 631 is inclined at a predetermined angle from a forward-rearward direction. The predetermined angle is about 30 degrees, for example. Thus, the plurality of cylinders 631 is V-shaped as viewed in the upward-downward direction.

The exhaust passage 80 preferably includes an exhaust pipe that communicates with exhaust ports 351 of the plurality of cylinders 631, into which exhaust gas discharged from the exhaust ports 351 of the plurality of cylinders 631 is collected. Specifically, the exhaust passage 80 is elongated in the upward-downward direction. The exhaust passage 80 is disposed between the pairs of cylinders 631 that face each other in the right-left direction. In particular, the exhaust passage 80 is disposed in a central portion of an internal space 37 of a cowling 21 in the right-left direction, and is disposed rearward of the engine 620.

An intercooler 642 is mechanically connected to the supercharger 4. The intercooler 642 is disposed forward of the engine 620 in the internal space 37 of the cowling 21. The supercharger 4 is disposed between an upper end of a first cylinder 61 and a lower end of the bracket 25 in the cowling 21. The intercooler 642 is disposed in the central portion of the internal space 37 of the cowling 21 in the right-left direction. That is, the intercooler 642 is disposed at a position that corresponds to a position between a left end of a left cylinder 631 and a right end of a right cylinder 631 of each pair of cylinders 631.

Compressed air compressed by the supercharger 4 and cooled by the intercooler 642 flows into intake ports 352 of the plurality of cylinders 631 through an air passage 641 of the supercharger 4 according to the fourth preferred embodiment. The air passage 641 connects the supercharger 4 to each of the plurality of cylinders 631. A first air passage 664 of the air passage 641 is disposed in a left portion of the internal space 37 of the cowling 21. The first air passage 664 is mechanically connected to the intercooler 642 and the left cylinders 631. A second air passage 665 of the air passage 641 is disposed in a right portion of the internal space 37 of the cowling 21. The second air passage 665 is mechanically connected to the intercooler 642 and the right cylinders 631. The length of the first air passage 664 is substantially the same as the length of the second air passage 665.

The remaining structures of the fourth preferred embodiment are similar to those of the first, second, and third preferred embodiments.

According to the fourth preferred embodiment of the present invention, the following advantageous effects are achieved.

According to the fourth preferred embodiment of the present invention, the engine 620 is a V-type or V-shaped engine. Thus, the length in the upward-downward direction is smaller than that of the outboard motor 600 including an in-line engine. Accordingly, the outboard motor 600 is compact.

According to the fourth preferred embodiment of the present invention, the engine 620 includes the exhaust passage 80 between the pairs of cylinders 631 that face each other in the right-left direction. Thus, an exhaust manifold connected to each of the plurality of cylinders 631 is integrated into and integral with the exhaust passage 80 between the pairs of cylinders 631. Therefore, the exhaust passage 80 is downsized, and hence a space between the engine 620 and the cowling 21 is increased.

According to the fourth preferred embodiment of the present invention, the intercooler 642 is disposed forward of the engine 620 and in the central or substantially central portion of the internal space 37 of the cowling 21 in the right-left direction. Thus, the intercooler 642 is disposed in the cowling 21 at a position forward of the engine 620, where a small number of auxiliaries are disposed such that a space is easily ensured. Consequently, the necessity of changing the shape of the cowling 21 due to the installation of the intercooler 642 is significantly reduced or prevented.

The remaining effects of the fourth preferred embodiment are similar to those of the first, second, and third preferred embodiments.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the supercharger 4 is preferably disposed forward of or rearward of the engine 20 (620) in each of the first, second, third, and fourth preferred embodiments described above, the present invention is not restricted to this. For example, the supercharger may alternatively be disposed on the right or left side relative to the engine.

While the supercharger 4 is preferably disposed between the upper end of the first cylinder 61 and the upper end of the bracket 25 in the cowling 21 in each of the first and second preferred embodiments described above, the present invention is not restricted to this. It is only required to locate the supercharger 4 below the upper end of the first cylinder 61. For example, the supercharger may be disposed below the upper end of the bracket.

While the side sectional shape of the cowling 21 (521) is preferably semicircular or substantially semicircular in each of the first, second, and third preferred embodiments described above, the present invention is not restricted to this. The side sectional shape of the cowling may alternatively have another shape.

While the "drive force transmission shaft" recited in the claims may be the crankshaft 33 and the drive shaft 22 in each of the first, second, third, and fourth preferred embodiments described above, the present invention is not restricted to this. The "drive force transmission shaft" may alternatively be another shaft, the rotational axis of which extends along the upward-downward direction.

While the drive gear 51 is preferably fitted into the second crank journal 56 in the first preferred embodiment described above, the present invention is not restricted to this. The drive gear may alternatively be fitted into another crank journal.

While the balancer drive gear 52 is preferably made of metal in the first preferred embodiment described above, the present invention is not restricted to this. For example, the balancer drive gear may alternatively be made of resin.

While the engine 20 (620) is preferably a four-cylinder engine in each of the first, second, third, and fourth preferred embodiments described above, the present invention is not restricted to this. For example, the engine may alternatively be a six-cylinder engine.

While in the engine 620, the exhaust passage 80 is preferably disposed between the pairs of cylinders 631 that face each other in the right-left direction in the fourth preferred embodiment described above, the present invention is not restricted to this. For example, an intake passage may alternatively be disposed between the pairs of cylinders that face each other in the right-left direction.

While the supercharger 4 is preferably disposed below the first connecting rod 58 in the first preferred embodiment described above, the present invention is not restricted to this. For example, the supercharger may alternatively be disposed between the upper end of the first cylinder and an upper end of the first connecting rod.

While the balancer drive gear is preferably disposed between the drive gear 51 and the driven gear 53 in each of the first and fourth preferred embodiments described above, the present invention is not restricted to this. For example, the balancer drive gear may be omitted.

While the drive gear 51 is preferably disposed on the crankshaft 33 in each of the first and fourth preferred embodiments described above, the present invention is not restricted to this. For example, the drive gear may alternatively be disposed on the drive shaft.

While the chain 70 is preferably disposed on the crankshaft 33 in each of the second and third preferred embodiments described above, the present invention is not restricted to this. For example, the drive gear may alternatively be disposed on the drive shaft.

While the chain 70 is preferably disposed below the lowermost cylinder 31 in each of the second and third preferred embodiments described above, the present invention is not restricted to this. For example, the chain may alternatively be disposed between the first cylinder and the lower end of the lowermost cylinder.

While the chain 70 (belt) preferably drives the supercharger 4 in each of the second and third preferred embodiments described above, the present invention is not restricted to this. For example, the chain (belt) may alternatively drive a camshaft of a valve train system simultaneously with driving the supercharger.

While an intermediate gear is preferably the balancer drive gear in the first preferred embodiment described above, the present invention is not restricted to this. For example, the intermediate gear may alternatively be a balancer drive gear including an anti-backlash mechanism inside the gear for noise reduction.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a plurality of cylinders;

a cowling including an internal space in which the engine is housed;

a drive force transmission shaft that rotates about a rotational axis extending in an upward-downward direction to transmit a drive force of the engine to a propeller;

a supercharger driven by the drive force transmission shaft; and a transmission that transmits a drive force of the drive force transmission shaft to the supercharger; wherein an upper end of the supercharger is disposed below an upper end of an uppermost one of the plurality of cylinders in the internal space of the cowling.

2. The outboard motor according to claim 1, wherein an upper end of the transmission is disposed below the upper end of the uppermost one of the plurality of cylinders in the internal space of the cowling.

3. The outboard motor according to claim 1, wherein the supercharger is disposed below an uppermost one of a plurality of connecting rods connected to a plurality of pistons disposed inside the plurality of cylinders in the internal space of the cowling.

4. The outboard motor according to claim 1, wherein the drive force transmission shaft includes a crankshaft; and the transmission includes a drive gear that is mounted on the crankshaft and drives the supercharger.

5. The outboard motor according to claim 4, wherein the transmission includes a driven gear mounted on the supercharger and an intermediate gear disposed between the drive gear and the driven gear.

6. The outboard motor according to claim 4, wherein the drive gear of the transmission is disposed between two adjacent ones of a plurality of connecting rods connected to a plurality of pistons disposed inside the plurality of cylinders.

7. The outboard motor according to claim 6, wherein a side sectional shape of the cowling is inclined forward and downward and along a shape of the engine from a central portion to a forward end of the cowling in a forward-rearward direction; and an intermediate gear of the transmission and the supercharger are disposed forward of a forward end of the engine in the internal space of the cowling.

8. The outboard motor according to claim 1, wherein the drive force transmission shaft includes a crankshaft; and the transmission is connected to the crankshaft at or near a lower end of the crankshaft, and the supercharger is disposed rearward of a rearward end of the engine.

9. The outboard motor according to claim 8, wherein the drive force transmission shaft includes a drive shaft connected to the crankshaft; and the transmission is connected to a connection between the crankshaft and the drive shaft, and the supercharger is disposed rearward of the rearward end of the engine.

10. The outboard motor according to claim 6, wherein the drive gear of the transmission is disposed between an uppermost one of the plurality of connecting rods and a connecting rod adjacent to the uppermost one of the plurality of connecting rods.

11. The outboard motor according to claim 8, wherein the transmission includes a chain or a belt that transmits a drive force of the crankshaft that is disposed in a forward portion of the engine to the supercharger that is disposed rearward of the engine.

12. The outboard motor according to claim 8, wherein the supercharger is disposed adjacent to the rearward end of the engine.

13. The outboard motor according to claim 8, wherein the supercharger is disposed below a lower end of the engine and rearward of the rearward end of the engine.

14. The outboard motor according to claim 1, wherein the engine is a V-shaped engine;

the engine includes a pair of cylinders that face each other in a direction perpendicular or substantially perpendicular to the upward-downward direction; and an exhaust passage or an intake passage is disposed between the pair of cylinders.

15. The outboard motor according to claim 1, wherein the engine is a V-shaped engine;

the engine includes a pair of cylinders that face each other in a direction perpendicular or substantially perpendicular to the upward-downward direction;

the outboard motor further comprises an intercooler that cools compressed air from the supercharger; and the intercooler is disposed forward of a forward end of the engine and at a position that corresponds to a position between the pair of cylinders in the internal space of the cowling.

16. A marine vessel comprising:

an outboard motor; and a vessel body on which the outboard motor is rotatably mounted; wherein the outboard motor includes:

an engine including a plurality of cylinders;

a cowling including an internal space in which the engine is housed;

a drive force transmission shaft that rotates about a rotational axis extending in an upward-downward direction to transmit a drive force of the engine to a propeller;

a supercharger driven by the drive force transmission shaft; and a transmission that transmits a drive force of the drive force transmission shaft to the supercharger; wherein an upper end of the supercharger is disposed below an upper end of an uppermost one of the plurality of cylinders in the internal space of the cowling.

* * * * *